United States Patent [19]

Gomez-Olea

[11] 4,287,733

[45] Sep. 8, 1981

[54] MAGNET-ELECTRONIC LOCK SYSTEM

[76] Inventor: Mariano Gomez-Olea, Vuelta del Castillo 3, 5°A, Pamplona, Spain

[21] Appl. No.: 24,443

[22] Filed: Mar. 27, 1979

[51] Int. Cl.[3] ..... E05B 19/00; E05B 47/00; E05B 49/00

[52] U.S. Cl. ..... 70/276; 70/278; 70/382; 70/395; 70/413

[58] Field of Search ..... 70/276, 278, 280, 413, 70/395, 382, 384

[56] References Cited

U.S. PATENT DOCUMENTS

| | | | |
|---|---|---|---|
| 3,416,336 | 12/1968 | Felson | 70/413 |
| 3,512,382 | 5/1970 | Check et al. | 70/413 X |
| 3,518,855 | 7/1970 | Wake | 70/276 |
| 3,552,159 | 1/1971 | Craig | 70/276 |
| 3,654,782 | 4/1972 | Heimann | 70/276 |
| 3,656,328 | 4/1972 | Hughes | 70/276 |
| 3,705,369 | 12/1972 | Schwendeman | 70/413 X |
| 4,019,355 | 4/1977 | Germonton | 70/276 X |
| 4,051,548 | 9/1977 | Hamada | 70/280 X |
| 4,228,667 | 10/1980 | Herriott | 70/413 X |

FOREIGN PATENT DOCUMENTS

| | | | |
|---|---|---|---|
| 2724025 | 12/1977 | Fed. Rep. of Germany | 70/276 |
| 2706919 | 8/1978 | Fed. Rep. of Germany | 70/413 |
| 2717200 | 11/1978 | Fed. Rep. of Germany | 70/276 |
| 2727126 | 12/1978 | Fed. Rep. of Germany | 70/413 |
| 2813053 | 12/1978 | Fed. Rep. of Germany | 70/276 |
| 1027535 | 2/1953 | France | 70/413 |
| 2378157 | 9/1978 | France | 70/413 |
| 40880 | 6/1937 | Netherlands | 70/382 |
| 147928 | 11/1954 | Sweden | 70/382 |
| 1484249 | 9/1977 | United Kingdom | 70/276 |

*Primary Examiner*—Roy D. Frazier
*Assistant Examiner*—Carl F. Pietruszka
*Attorney, Agent, or Firm*—Karl F. Ross

[57] ABSTRACT

A lock system has an elongated key provided with a plurality of permanent magnets spaced axially and angularly apart along the key in a predetermined magnet array. A cylinder having no moving parts defines a passage generally complementary to this key and provided with a plurality of magnetic-field detectors at least some of which are arrayed to be in line with the magnets of the key when it is inserted into the passage. An electronic circuit is connected to these detectors and to an electrically operable latch and is programmed to open the latch when those detectors that are in line with the permanent magnets change state in a manner indicating that they are juxtaposed with the respective magnets, but not when one or more detectors out of line with the magnet array are similarly subjected to a magnetic field.

8 Claims, 6 Drawing Figures

Fig. 1
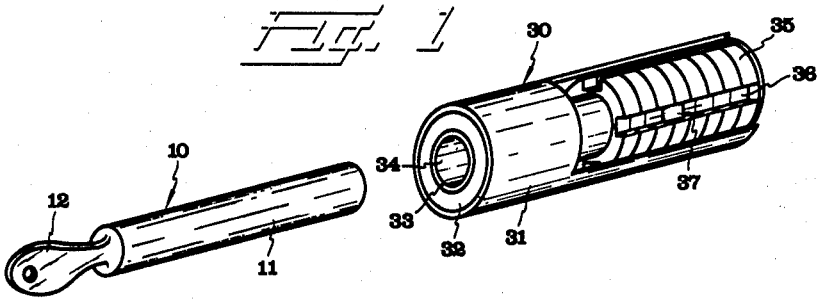
Fig. 2
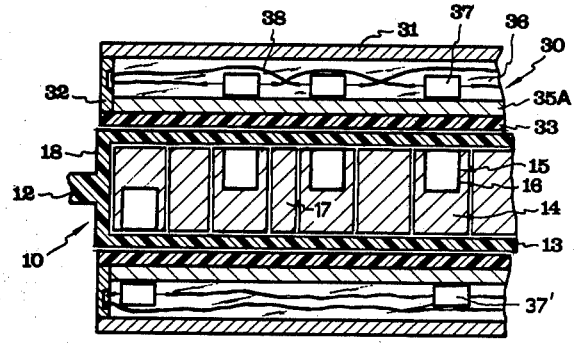
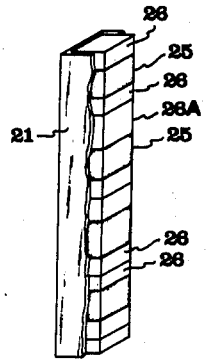
Fig. 4
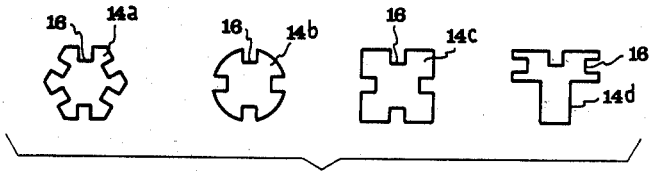
Fig. 3
Fig. 5
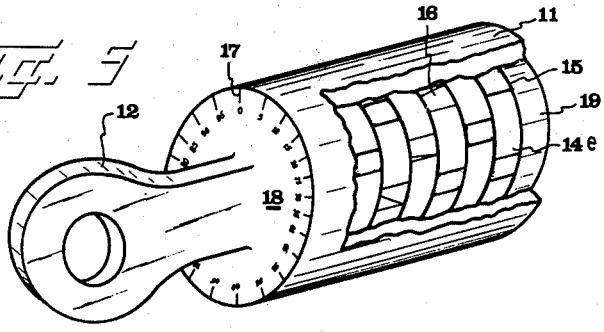

MAGNET-ELECTRONIC LOCK SYSTEM

FIELD OF THE INVENTION

The present invention relates to a nonmechanical lock system. More particularly this invention concerns a magnetic-electronic lock system that is used to electrically operate a latch.

BACKGROUND OF THE INVENTION

The recent trend in locks has been toward arrangements where the traditionally used mechanical key and lock are avoided. Actuating devices have been devised for obviating a key so as to prevent tampering with the lock as has become a problem with mechanical-key actuated locks.

The simplest of these devices employs an electrical signal to actuate a relay capable of operating the latch. A complicated device is triggered by a radio signal of a predetermined frequency which is detected by a tuned coil and analyzed by a circuit to operate the latch. A device is also known wherein a printed-circuit card carries a key circuit and has a plurality of terminals exposed along one edge and fittable into a socket connected to further circuitry that opens the latch when this circuitry ascertains that the circuit on the magnetic card corresponds to the key circuit.

These devices have several disadvantages. The use of an expensive radio transmitter greatly elevates the cost of the lock system, as does that of a complex computer to read a circuit-carrying card. Coils of the radio system can become saturated due to induction from transients or parasitic currents. The card-type system can be overcome by obstructing the passage so as to make the card completely uninsertable, or by temporarily borrowing a card so as to decipher the circuit thereon.

It has been suggested to simplify and lower the cost of such devices by employing a key-operated switch of the mechanical type which in turn operates a latch. In such an arrangement an extremely sophisticated key of very complex bitting is employed to minimize the possibility of the lock being picked, and the latch itself is normally in a completely tamperproof location. Such an arrangement has, however, numerous disadvantages of the mechanical-type lock along with many of the disadvantages of the electrical lock. It does have the advantage of relatively low cost, but this alone has not proven to be a strong enough factor to warrant widespread use of such a lock.

OBJECTS OF THE INVENTION

It is therefore an object of the present invention to provide an improved lock system.

Another object is to provide such a system which is relatively tamperproof and which can be produced at relatively low cost.

Yet another object is the provision of a completely nonmechanical lock-actuating system.

A further object is to provide a lock system wherein the number of available bittings or combinations is very large.

SUMMARY OF THE INVENTION

These objects are attained according to this invention in a lock system having an elongated key extending along a key axis and having a plurality of permanent magnets spaced axially and angularly apart in a predetermined magnet array relative to the key axis. A cylinder defining a passage generally complementary to the key extends along the passage axis and is provided with a plurality of magnetic-field detectors spaced axially and angularly apart in the cylinder relative to the passage axis in a detector array generally complementary to the magnet array. Each detector is capable of changing state on juxtaposition with the respective permanent magnet and is connected through an electronic circuit to an openable latch. This circuit opens the latch only when all of the detectors have changed state on juxtaposition with the respective magnets of the key.

The actuating device of this invention can be relatively remote from the mechanical latch itself so that the position of the actuating device will give no clue as to where the latch itself is located. The latch itself can be either of the standard bolt or dead bolt type, or can be of the multiple bolt type employed in a safe. Furthermore, the electronic circuit may be provided with a time-operated blocking circuit which completely prevents the opening of the latch and may even set off an alarm whenever a foreign element is introduced into the cylinder passage or the key has been introduced in the wrong position.

This is in accordance with yet another feature of this invention wherein the angular position of the key within the passage is relatively important for operation of the lock. Thus the key itself can be provided with an array of angularly offset numbers, and the passage may be provided with a pointer, so that the user knows to position a given number adjacent the pointer to make the latch operate. If this number is not positioned next to the pointer within a predetermined time after insertion of the key into the passage, the latch would be blocked and an alarm unit may be sounded.

It is possible to operate the device so that simple insertion of the key in the proper position will cause opening of the latch. Alternately according to a further feature of this invention it is possible to set the system up for operating with a predetermined numerical combination. In this arrangement the key must be inserted in a predetermined position, then displaced angularly through a predetermined sequence of other positions. This is most easily done by providing an angular numerical array of numbers on the key and a pointer on the cylinder, or vice-versa. For such an arrangement, of course, a multiplicity of magnetic detectors equal to many times the numbers of magnets on the key is normally needed. The microprocessor that operates the lock system is stepped in a sequence each time the key is moved within a predetermined time from a proper position to the next proper position. If the key is not moved to the next predetermined position within a set time, the microprocessor is cleared and the combination must be tried again. Furthermore if after several unsuccessful attempts the lock is not opened the microprocessor is set up to shut down and, if desired, sound an alarm. Such a system therefore ensures that if the key or the combination falls into the wrong hand, it will still be impossible to operate the lock system. A considerable advantage of this sytem is that, due to its wholly electronic nature, it is possible for the combination at least to be changed readily. Such an arrangement can be used for a safe.

According to this invention the key may be of any smooth shape, formed of uniform cross section so that it will itself be subject to no substantial mechanical stress. The passage is normally open at both ends so as to prevent the possibility of something blocking it. Furthermore if the key and passage are both made cylindrical the above-described possibility of using different angular positions of the key either for a one-part combination of a several-part combination is possible.

According to this invention the key itself is made as a stack of disks received within a nonmagnetic sleeve. Each of these disks has a plurality of radially open recesses. Permanent magnets are fitted into these recesses and the entire assembly is then held together by the outer nonmagnetic sleeve. Similarly the cylinder itself is formed as a tube constituted of a stack of rings having radially open recesses and a liner sleeve. The detectors are fitted into the recesses of the rings in an array corresponding to that of the magnets on the key. Such an arrangement allows the basic elements of the lock system to be assembled by the user if desired for establishing his or her own magnetic bitting of the key. It similarly allows subsequent disassembly and rebitting of the lock system as desired.

As mentioned above it is a feature of this invention to provide at least one detector at a location that will be out of line with any of the permanent magnets on the key when the key is properly positioned in the cylinder. This detector is connected to the microprocessor of the lock system in such a manner that if it detects a magnetic field it will prevent operation of the latch. Thus in the event that a heavy magnet is applied to the lock in an attempt to open it without using the proper key, this detector will prevent opening of the latch.

BRIEF DESCRIPTION OF THE DRAWING

FIG. 1 is a perspective view of parts of the lock system according to the instant invention;

FIG. 2 is a section through a detail of a lock system according to this invention;

FIG. 3 shows a plurality of end views of various keys according to the instant invention;

FIG. 4 is a partly broken-away perspective view of another key according to this invention;

FIG. 5 is a partly broken-away perspective view of another key for a combination-type lock according to this invention.

SPECIFIC DESCRIPTION

Figure 6:
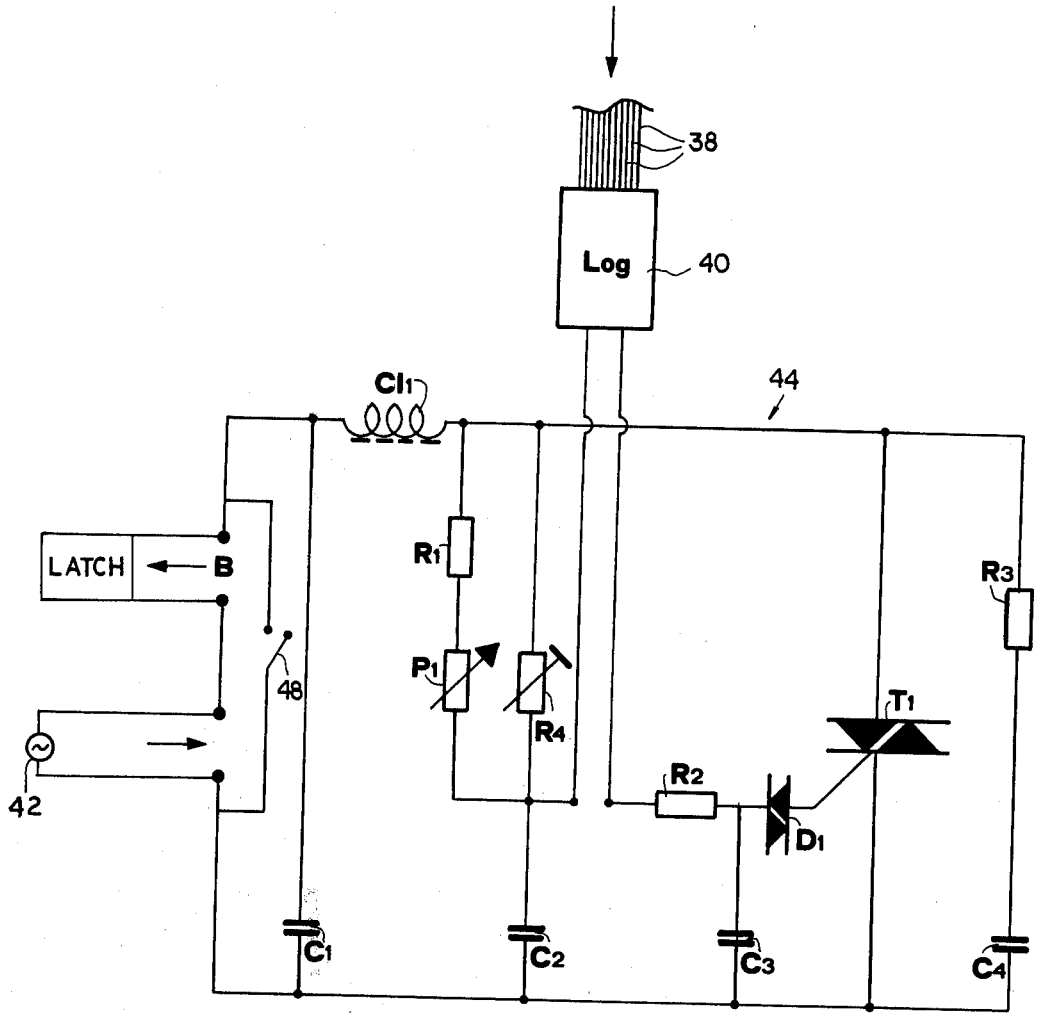
FIG. 6 is a schematic diagram of the control circuit for the locks according to the system of this invention.

FIG. 1 shows a nonmechanical key 10 having an insertion portion 11 and a holding portion 12, and a cylinder 30 having an outer sleeve 31, an inner sleeve 33, and a pair of end sleeves 32, together defining a cylindrical passage 34. This passage 34 is open at both ends, and the inside diameter of the passage 34 is slightly greater than the outside diameter of the insertion portion 11. A stack of rings 35 is contained between the walls 31–33, each of these rings 35 being formed with four angularly equispaced and radially outwardly open recesses 36 any of which can receive a detector 37 or 37'.

FIG. 2 shows how the key 10 has an outer sleeve 13 provided with a stack of disks 14 each formed with one or more radially outwardly opening recesses 16 capable of receiving a small permanent magnet 15. In addition spacers 17 of axial length different from that of the disks 14 may be employed. The key is dimensioned so that the end surface 18 of the insertion part 11 is flush with the front end ring 32 of the cylinder 30.

As can be seen in FIG. 2 each of the permanent magnets 15 is aligned with a respective sensor 37 of the Hall-effect type. Furthermore at least one further sensor 37' is provided at a location that is not normally aligned with a permanent magnet 15. Obviously both the axial and angular spacing of the magnets 15 and of the detectors 37 and 37' can be varied. Conductors 38 lead from the various detectors 37 and 37'.

FIG. 3 shows how hexagonal members **14*a* each having six radially outwardly open recesses 16 can be provided. The round disk 14*b* of FIG. 3 is substantially identical to that used in the arrangement of FIGS. 1 and 2. A square members 14*c* having four recesses 16, or a T-shaped member 14*d* having three recesses 16 may also be employed. The members 14*a*, 14*c* and 14*d*** would be employed in systems wherein the key should not rotate within the passage.

FIG. 4 shows an arrangement wherein a square-section key is provided having permanent magnets 25 stacked between short spacers 26 and wide spacers 26A. This arrangement does not employ angular spacing of the magnets 25, but merely uses the relative axial spacing. For all such arrangements the detectors would be mounted in a complementary array with at least one detector 37' provided at a location that would not normally be aligned with a permanent magnet when fully inserted.

In the arrangement of FIG. 5 the end wall 18 is provided with angularly equispaced indicia 17 and round disks **14*e* are provided each having six recesses 16, some of which are provided with magnets 15. In addition FIG. 5 shows the rear end wall 19 of the key. The indicia 17 would be lined up with a pointer provided on the end wall 32 for combination-type use of the lock system. The detectors 37 can simply be wedged into the recesses 36 or glued in place. Alternately a continuous grooved tube 35A such as shown in FIG. 2 can be employed, with the various detectors 37 and 37' being glued in place or potted with an appropriate nonmagnetic material. In all cases the walls between the detectors 37 and 37' and the magnet 15 are made of nonmagnetic material, normally a synthetic resin, so that the magnetic fields from the magnets 15 can pass through this structure to the Hall-effect detectors 37 and 37'**. A synthetic resin having an extremely low coefficient of friction, such as polytetraflurethylene, is ideally suited for such application.

FIG. 6 shows how the conductors 38 are all connected to a microprocessor 40 in turn connected to a logic circuit 44 acting as a switch between a source 42 of line voltage and electromagnetic door latch. This actuating circuit is operated by a pulse from the microprocessor 40 which is applied through a resistor R2 and a diac D1 to a triac T1 connected in series with a coil CL 1 across the latch and source 42. The threshold voltage for the triac T1 is determined by the capacitors C1–C4, as well as by the resistors R1–R3, the variable resistor R4, and the potentiometer P1. Thus the relatively small pulse from the microprocessor 40 can allow a relatively large current to flow through the triac T1 to the latch. An emergency operation switch 48 is provided to operate the latch also.

The microprocessor 40 can be programmed so as to produce a pulse that closes the triac T1 whenever all of the detectors 37 sense a magnetic field, but the detector 37' does not. Alternately, when using a key such as that shown in FIG. 5, the processor 40 can be programmed to emit the pulse that is applied to the gate of the triac T1 only after a plurality of different inputs have been received in a predetermined sequence, that is after the key shown in FIG. 5 has been turned through a predetermined sequence of angularly offset positions. Thus the key shown in FIG. 5 can in fact act as the movable element of a completely nonmechanical combination lock, with the added security that the operating element of the lock can be removed if desired.

I claim:

1. A lock system comprising:

an elongated key extending along a key axis and having a stack of axially succeeding disks only some of which are formed with radially outwardly open recesses, respective permanent magnets in some of said recesses and spaced axially and angularly apart in a predetermined magnet array relative to said key axis, and a nonmagnetic sleeve surrounding said disks and retaining said magnets in the respective recesses;

a cylinder formed by a stack of axially succeeding rings some of which are formed with radially open recesses and which together define a passage generally complementary to said key and extending along a passage axis;

a plurality of magnetic detectors spaced axially and angularly apart in said recesses of said cylinder relative to said passage axis in a detector array generally complementary to said magnet array, each detector being capable of changing state on juxtaposition with the respective magnet;

an openable latch; and electronic circuit means connected between said latch and said detectors for opening said latch when all of said detectors have changed state on juxtaposition with the respective magnets of said key.

2. The system defined in claim 1 wherein said key has an insertion portion of uniform cross section insertable in said passage and a holding portion that normally remains outside said passage.

3. The system defined in claim 2 wherein said passage is axially open at both axial ends.

4. The system defined in claim 2 wherein said key is rotatable about said key axis when said insertion portion is in said passage.

5. The system defined in claim 4 wherein said cylinder is provided with further detectors for sensing said magnets in any of a plurality of different angularly offset positions of said key in said passage, said means only operating said latch when said detectors have changed state in a predetermined sequence as a result of displacement of said key through a predetermined sequence of angularly offset positions.

6. The system defined in claim 2 further comprising at least one second such detector normally not aligned with one of said magnets when said key is inserted in said passage with said magnets aligned with the first-mentioned detectors, said means including further means for preventing operation of said lock when said second detector is juxtaposed with a magnet and changes state.

7. The system defined in claim 2 wherein said passage is lined with a nonmagnetic sleeve.

8. The system defined in claim 2 wherein said insertion portion and said passage are substantially cylindrical.

* * * * *